US008087280B2

(12) United States Patent
Battenfeld et al.

(10) Patent No.: US 8,087,280 B2
(45) Date of Patent: Jan. 3, 2012

(54) SPREADING PLIERS

(75) Inventors: Kurt Battenfeld, Ebsdorfergrund (DE); Thomas Glockseisen, Düsseldorf (DE)

(73) Assignee: WEZAG GmbH Werkzeugfabrik, Stadtallendorf (DE)

( * ) Notice: Subject to any disclaimer, the term of this patent is extended or adjusted under 35 U.S.C. 154(b) by 438 days.

(21) Appl. No.: 12/361,733

(22) Filed: Jan. 29, 2009

(65) Prior Publication Data

US 2009/0193942 A1 Aug. 6, 2009

(30) Foreign Application Priority Data

Feb. 2, 2008 (DE) ..... 10 2008 007 303

(51) Int. Cl.
*B25B 7/12* (2006.01)
*B25B 27/10* (2006.01)
*B21D 1/12* (2006.01)

(52) U.S. Cl. ..... 72/392; 72/409.01; 72/409.12; 72/409.17; 81/302

(58) Field of Classification Search ..... 72/392, 72/409.01, 409.12, 409.17, 705; 81/302, 81/368, 418
See application file for complete search history.

(56) References Cited

U.S. PATENT DOCUMENTS

| | | | | |
|---|---|---|---|---|
| 2,222,744 | A * | 11/1940 | Gallien, Jr. | 72/392 |
| 2,769,358 | A * | 11/1956 | Hill | 72/392 |
| 4,257,135 | A | 3/1981 | Moebius | |
| 5,122,130 | A * | 6/1992 | Keller | 81/302 |
| 5,382,151 | A * | 1/1995 | Hayes et al. | 72/392 |
| 5,398,535 | A | 3/1995 | Giffin | |
| 5,423,236 | A | 6/1995 | Bickler | |
| 6,415,641 | B1 | 7/2002 | Wagner | |
| D545,155 | S * | 6/2007 | Kang | D8/54 |

FOREIGN PATENT DOCUMENTS

| | | | |
|---|---|---|---|
| CA | 1 231 563 | A1 | 1/1988 |
| DE | 28 51 282 | C2 | 9/1987 |
| DE | 36 17 529 | A1 | 11/1987 |
| DE | 44 46 503 | C1 | 5/1996 |
| DE | 196 21 877 | C2 | 6/2002 |
| DE | 101 41 077 | A1 | 3/2003 |
| DE | 102 43 707 | B3 | 1/2004 |
| DE | 20 2004 008 603 | U1 | 10/2004 |
| DE | 10 2006 022 999 | A1 | 11/2007 |
| DE | 93 07 957 | U1 | 4/2009 |
| EP | 0 598 173 | B1 | 3/1993 |
| EP | 1 055 488 | B1 | 5/2000 |
| JP | 2000117655 | A | 4/2000 |

OTHER PUBLICATIONS

European Search Report in related, co-pending Application No. 09151423.2, mailed May 19, 2009.

* cited by examiner

*Primary Examiner* — David Jones
(74) *Attorney, Agent, or Firm* — Thomas, Kayden, Horstemeyer & Risley, LLP

(57) ABSTRACT

The invention relates to pliers for changing the distance of two activation surfaces of a connection or fitting for conduits. The change of the distance correlates with an elastic or plastic deformation of at least one component of the fitting including a radial crimping process. The inventive pliers comprise two hand levers linked by a transfer mechanism with two spreading jaws. According to the invention, a closing movement of the hand levers results in a spreading movement of the spreading jaws. Such spreading movement of the spreading jaws is used for plastically deforming at least one of the components of the connection by a radial crimping process.

14 Claims, 8 Drawing Sheets

SPREADING PLIERS

CROSS REFERENCE TO RELATED APPLICATIONS

This application claims priority to co-pending German Patent Application No. DE 10 2008 007 303.2 entitled "Spreizzange", filed Feb. 2, 2008.

FIELD OF THE INVENTION

The present invention generally relates to pliers used for connecting conduits wherein a conduit, pipe or tube (in the following "conduit") might be connected with another conduit, port or connector via a suitable fitting.

BACKGROUND OF THE INVENTION

Known are connections for conduits having components comprising two activation surfaces. These activation surfaces are pressed towards each other for building up the connection. Conical or wedge-like surfaces of the connection transform an axial movement of the components pressed towards each other into a plastic deformation of at least one component of the connection. Such plastic deformation might be used for radially compressing the components of the connection for building up a fixed and sealed connection.

European Patent No. EP 1 055 488 B1, corresponding to U.S. Pat. No. 6,415,641 discloses a clamping fitting with two parts, i.e. a supporting sleeve and a clamping sleeve. For connecting ends of conduits with each other one end of a conduit is widened and houses the clamping fitting. The widening process represents an additional costly step. A device axially presses the clamping sleeve into a final position, wherein the clamping sleeve abuts the clamping fitting. Another clamping technique uses a clamping ring and a squeezing ring passed over a conduit. A supporting sleeve is introduced into the conduit. The device axially presses the clamping ring versus the squeezing ring until a stop element built from the supporting sleeve is reached. For such modification a widening of the conduit is not necessary.

Another connection for conduits is disclosed on the website www.schell-armaturen.de/deutsch/downloads/pex_bosch.pdf, wherein the connection is used for sanitary facilities or heating devices. The conduits used might be made of high molecular polyethylene. The conduits are manufactured without any flashes or burrs. Furthermore, for preparing the connection each conduit is cut to the desired length with a cut strictly perpendicular to the longitudinal axis of the conduit. A sleeve is passed over the conduit. A special widening tool is inserted into the opening of the conduit. After the use of the widening tool a fitting is inserted into the widened open cross-section of the conduit. An end position of the fitting in the widened conduit is given for the front surface of the conduit abutting a stop element of the fitting. A pressing tool with an electric drive unit presses the sleeve axially versus the stop element for finishing the clamping or crimping process.

A further embodiment for a sealed pressure connection made of metal might be taken from website www.mapress.de/geberit, wherein the disclosed product is distributed under the trademark MapressMAM. The connection is used for industrial applications under rough conditions, i.e. high pressures, changes of the pressure, rough temperature conditions and corrugation. For building an undetachable connection a ring made of stainless steel is passed over the conical outer end region of a fitting. Conduit, fitting and ring are connected by axially pressing these components against each other. The connection might be built without any additional sealing elements. The fitting might provide five defined pressure zones for producing a permanently sealed connection.

German Patent No. DE 44 46 503 C1 suggests to use a pressing tool activated by a pressure medium for axially moving the components of a connection.

The application of an axial movement might be simplified by use of a manually operated tool. German "Gebrauchsmuster" No. DE 93 07 957 U1 discloses pressure pliers having hand levers pivoted around a pivoting bolt. The end regions of the hand levers opposite to the end regions gripped by the hand of the user are pivotably linked with base jaw elements. The base jaw elements comprise grooves directed transverse to the pressing direction. Pressure jaws comprise D-shaped sliding blocks engaging the grooves. The pressure jaws might be U-shaped building an opening, wherein the width of the opening approximately correlates with the diameter of the ends of the conduits, a sleeve or a sliding sleeve. From the outside the pressing jaws grip activation surfaces built by a collar of the sleeve and an outer front surface of the sliding sleeve. With a pivoting movement of the hand levers versus each other the base jaw element and the pressing jaws are pivoted versus each other. Such pivoting movement correlates with a relative movement of the collar contacting one of the pressing jaws and the sliding sleeve contacting the other pressing jaw. Due to the pivotable link of the end regions of the hand levers with the base jaw elements, during the axial movement the pressing jaws are automatically held in a parallel orientation for providing a uniform contact between the pressing jaws and the activation surfaces. DE 28 51 282 discloses similar pressing jaws.

Additional manually applied pressing pliers are known from German Patent Application No. DE 36 17 529 A1.

German "Gebrauchsmuster" No. DE 93 07 957 U1 discloses pressing pliers having hand levers pivotably linked in X-shape by a bolt. The end regions of the hand lever facing the work piece are pivotably linked with base bodies having U-shaped nests for sleeves. These sleeves are pressed against each other in axial direction with a pivoting movement of the hand levers versus each other. The U-shaped nests are releasably fixed at the base bodies via T-slots. The U-shaped nests are held in parallel orientation during the pressing movements. This is done by linking the base body both with one end region of a first hand lever and a spring pressing the base body against a pin fixed at the second hand lever. German Patents DE 28 51 282 C2, corresponding to U.S. Pat. No. 4,257,135 and DE 36 17 529 C2 disclose embodiments of pressing tools basing on the same mechanism for keeping the nests in parallel orientation.

German "Gebrauchsmuster" DE 20 2004 008 603 U1 discloses pliers for bringing retaining rings according to German norm DIN 471/472 under tension and releasing these retaining rings. For these pliers the two hand levers in closed state build in a rough approximation the contour of a H wherein the transverse leg of the H is shifted versus the upper end region of the two longitudinal legs and the two hand levers are pivotably linked in the middle of the transverse leg. The end regions of the hand levers facing the work piece are pivotably linked with the end regions of jaws. The jaws cross each other building an X with a joint at the crossing point. For opened hand levers the nests of the jaws have a minimal distance with parallel orientation. However, with a closing movement of the hand levers the nests separate from each other with an increasing angle built by the two nests.

German Patent No. DE 196 21 877 C2 discloses pressing pliers driven by hand with a pistol-like design for pressing sleeves upon tubes or fittings. The trigger of the pistol builds a movable hand lever, whereas the handle of the pistol builds a fixed hand lever. A front nest is fixed at the end of the barrel of the pistol. Another nest is guided for a movement along the barrel of the pistol. A repeated closing movement of the hand levers is transferred by an eccentric drive mechanism drive and a ratchet link to a pressing movement of the movable nest versus the fixed front nest.

German Patent Application No. DE 10 2006 022 999 A1 discloses pliers wherein multi-part hand levers are linked with each other building an X. A supporting body building U-shaped nests is linked with the end regions of the hand levers facing the work piece. The U-shaped nests are held in parallel orientation during a spreading movement with a closing movement of the hand levers. For that purpose the supporting bodies each comprise pins having an orientation transverse to the spreading axis. The pins each have a bore parallel to the spreading axis. A guiding rod penetrates the aforementioned bores of the two supporting bodies.

European Patent No. EP 0 598 173 B1 discloses a pressing tool with an external drive built by a drilling machine. By means of a spindle drive the driving movement of the drilling machine is transferred to a translational relative movement of two plates. Each of the plates at the circumference comprises a plurality of U-shaped nests. In order to use the pressing tool for work pieces or tubes having different dimensions the plurality of nests of the plates have different opening sizes. It is possible to rotate the plates around the pressing axis for bringing different nests into an operating position.

European Patent No. EP 1 055 488 B1, corresponding to U.S. Pat. No. 6,415,641 discloses a pistol-like pressing tool with an electro-hydraulic drive. A hydraulic pressure acting upon a cradle moves a nest having a translational degree of freedom versus a fixed nest for pressing a work piece.

Japanese Patent Application No. JP 2000117655 A discloses crimping pliers with a L-shaped hand lever. Another hand lever is pivotably linked with the shorter transverse leg of the L. A nest for a work piece is fixed at the L-shaped hand lever. Another nest is guided by the transverse leg of the L in pressing direction. A curved front surface of the pivotable hand lever comprises a toothing meshing with a linear toothing of the movable nest such that a pivoting movement of the hand levers correlates with a translatory relative movement of the two nests.

SUMMARY OF THE INVENTION

It is an object of the present invention to provide pliers providing a variable use in a plurality of working fields and/or with different applications or geometries of work pieces.

According to the invention, the pliers comprise two spreading jaws being spread apart during the working movement of the pliers. The closing movement of the hand levers coincides with an increase of the distance of the spreading jaws and activation surfaces of the same. Such increase of the distance of the spreading jaws causes a plastic deformation of at least one component of a connection coinciding with a radial clamping or crimping of the connection.

In order to produce spreading forces in the desired amount the pliers comprise a first transfer mechanism. The first transfer mechanism transfers activation forces manually applied upon the hand levers to the spreading jaws, wherein the first transfer mechanism comprises a transmission ratio increasing the activation forces on their path versus the spreading jaws.

According to one embodiment, the use of a suitable first transfer mechanism produces spreading forces in the range of 10,000, 20,000, 30,000, 40,000, 50,000, 60,000 or up to 70,000 Newton when manually applying forces with one hand or two hands upon the hand levers.

Any transfer mechanism known from the prior art might be used in the inventive pliers, see also the aforementioned publications of the applicant. However, according to one embodiment, the first transfer mechanism comprises a toggle mechanism. A toggle mechanism provides with a small number of components and a simple design the required spreading forces. It is also possible to integrate a plurality of toggle mechanism into the pliers, wherein the plurality of toggle lever mechanisms might be used in parallel configuration or might be used one after another (series-configuration).

According to the invention spreading elements are provided. These spreading elements are designed and arranged for interacting or engaging the components of the connection or fitting. The spreading elements are connected via a second transfer mechanism with the spreading jaws. The second transfer mechanism converts the pivoting movement of the spreading jaws into a (more or less) translational movement of the spreading elements along a spreading axis. This embodiment relies on the finding that a pivoting movement of the spreading jaws correlates with the movement of contact points of the spreading jaws with the connection on a circle. A rigid coupling of the activation surfaces with the spreading jaws would have the result that the contact points of the activation surfaces and their orientation change during the spreading movement. The use of the second transfer mechanism removes such dependency of the contact point of the activation surfaces and the orientation on the spreading movement. For the second transfer mechanism, any known kinematics and transfer or transmission system might be used.

The guidance and alignment of the spreading elements is improved by guiding the spreading elements directly against each other along the spreading axis.

Due to the fact that according to the invention the spreading elements are rotatable with respect to the spreading axis it is possible to use one and the same nest in different relative positions to the other components of the pliers.

For another embodiment of the invention, in the toggle mechanism a toggle lever joint builds a first angle for opened hand levers and closed spreading jaws. The angle increases with a closing movement of the hand lever to a second angle of the toggle lever joint wherein the second angle is larger than the first angle. This embodiment bases on the finding that during the spreading process the spreading movement of the spreading jaws requires increasing spreading forces. At the start of the spreading movement, the components of the connection might only move in an axial sliding movement. In a subsequent spreading phase one component of the connection might be deformed into contact with another component of the connection. In a further subsequent spreading phase, the spreading movement of the spreading jaws causes a radial deformation of a plurality of components. Accordingly, the required spreading force increases throughout the spreading process. Such finding is taken into account by means of the aforementioned increase of the angle of the toggle lever joint throughout the spreading process: Such increase of the angle leads to an increase of the transmission ratio throughout the transfer of the forces manually applied upon the hand levers towards the spreading jaws. On the other hand, such "automatically adapted" change of the transmission ratio has the following effect on the kinematics: at the start of the spreading movement a small movement of the hand levers versus each other might correlate with a large spreading movement of the spreading jaws in the first spreading phase. Accordingly, the automatically adapted change of the transmission ratio might guarantee an easy and fast first spreading phase.

Instead, in the subsequent spreading phases requiring larger spreading forces the spreading forces might be correlated with larger movements of the hand levers comprising a larger transmission ratio and giving a sensitive feedback of the crimping process to the user.

According to a special embodiment of the inventive pliers, the second angle of the toggle lever joint is in the range of 170° and 179° so that versus the end of the spreading movement the optimal transmission ratio of the toggle lever link is used.

According to another embodiment of the inventive pliers, the pliers comprise a "fixed" part having a first hand lever rigidly connected with a first spreading jaw. The fixed part serves for bearing a pressure rod. Furthermore, the second spreading jaw is pivotably linked with the fixed part. A movable part of the pliers in its end region is pivotably linked with an end region of the second spreading jaw, whereas the other end region of the movable part of the pliers builds the second hand lever. Additionally, the movable part of the pliers is pivotably linked with the pressure rod. The linking point is located between the hand lever and the end region linked with the second spreading jaw. Pliers built in such design have a simple but efficient construction leading to a spreading movement of activation surfaces with a closing movement of the hand levers.

For one embodiment of the invention, the second transfer mechanism is built by a joint located at each of the spreading jaws.

Furthermore, the invention suggests building a nest for a component or work piece at each of these spreading elements. In case of the spreading elements being removable or exchangeable different spreading elements might be used for the same pliers for building different connections. Accordingly, a tool set might be offered comprising pliers with a plurality of spreading elements. However, it is also possible that one and the same spreading element comprises a plurality of exchangeable nests.

Furthermore, the invention suggests pliers for multifunctional use, wherein the spreading elements comprise a plurality of nests located equidistant in circumferential direction. Due to the fact that the spreading elements are rotatable with respect to the spreading axis it is possible to use one and the same nest in different relative positions to the other components of the pliers. Accordingly, for example a use of one and the same nest might be used in different operating positions. The rotational degree of freedom of the spreading elements gives the opportunity of rotating a nest of the spreading element from one position to another position so that a plurality of nests via a rotation might be brought into one single operating position.

Furthermore, the pliers might comprise a fixing, resting or locking unit. Such unit is used for fixing the spreading elements for defined angles of rotation with respect to the spreading axis.

For a further embodiment of the invention, the unit is built with a spring-biased resting unit, a magnetic resting unit or a locking unit. Here, a "resting unit" describes a unit stabilizing a position such that forces below a defined force level directed for a movement away from the stable position cause corresponding return forces so that the stable position maintained. Instead, for exceeding the defined force level the stable position is left. To give only one example, a resting sphere biased by a spring versus a groove, bore or the like of the relatively moved component might be used for building a resting unit. The choice of the diameter of the resting element as the sphere and the geometry or contour of the groove, bore or the like determines the resting characteristic and the aforementioned defined force level. For another embodiment, the resting unit might use return forces caused by magnets, wherein the defined force level depends on the dimension and the magnetic properties of a permanent magnet. However, according to the invention a "locking unit" describes a unit, wherein a relative position is secured under a positive lock. Without manual activation of the user it is not possible to move the components secured by the locking unit out off the secured position without plastic deformation or destruction of at least one component of the locking unit.

A simple and efficient guidance is given when designing one spreading element with a recess or as a sleeve, wherein an inner bore of the sleeve or the recess houses a protrusion of the other spreading elements. The engagement between the protrusion and the recess or the inner bore of the sleeve guarantees the guidance for the relative movement of the spreading elements along the spreading axis. In case of the protrusion and the recess or inner bore of the sleeve having a circular cross-section, the guidance guarantees both a translational degree of freedom along the spreading axis and a rotational degree of the spreading elements against each other around the spreading axis. In case of the rotational degree not being of interest, such rotational degree might be blocked by giving the contours of the protrusion and the recess or inner bore of the sleeve non-circular corresponding cross-sections.

The pliers according to the invention (comprising a spreading movement of the spreading jaws with a closing movement of the hand levers) are used for connecting conduits or tubes. When using the pliers, two components of the connection directly or indirectly contact the spreading jaw or the spreading element. With a closing movement of the hand levers of the pliers and the spreading movement of the spreading jaws at least one component of the connection is plastically deformed in radial direction.

Other features and advantages of the present invention will become apparent to one with skill in the art upon examination of the following drawings and the detailed description. It is intended that all such additional features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
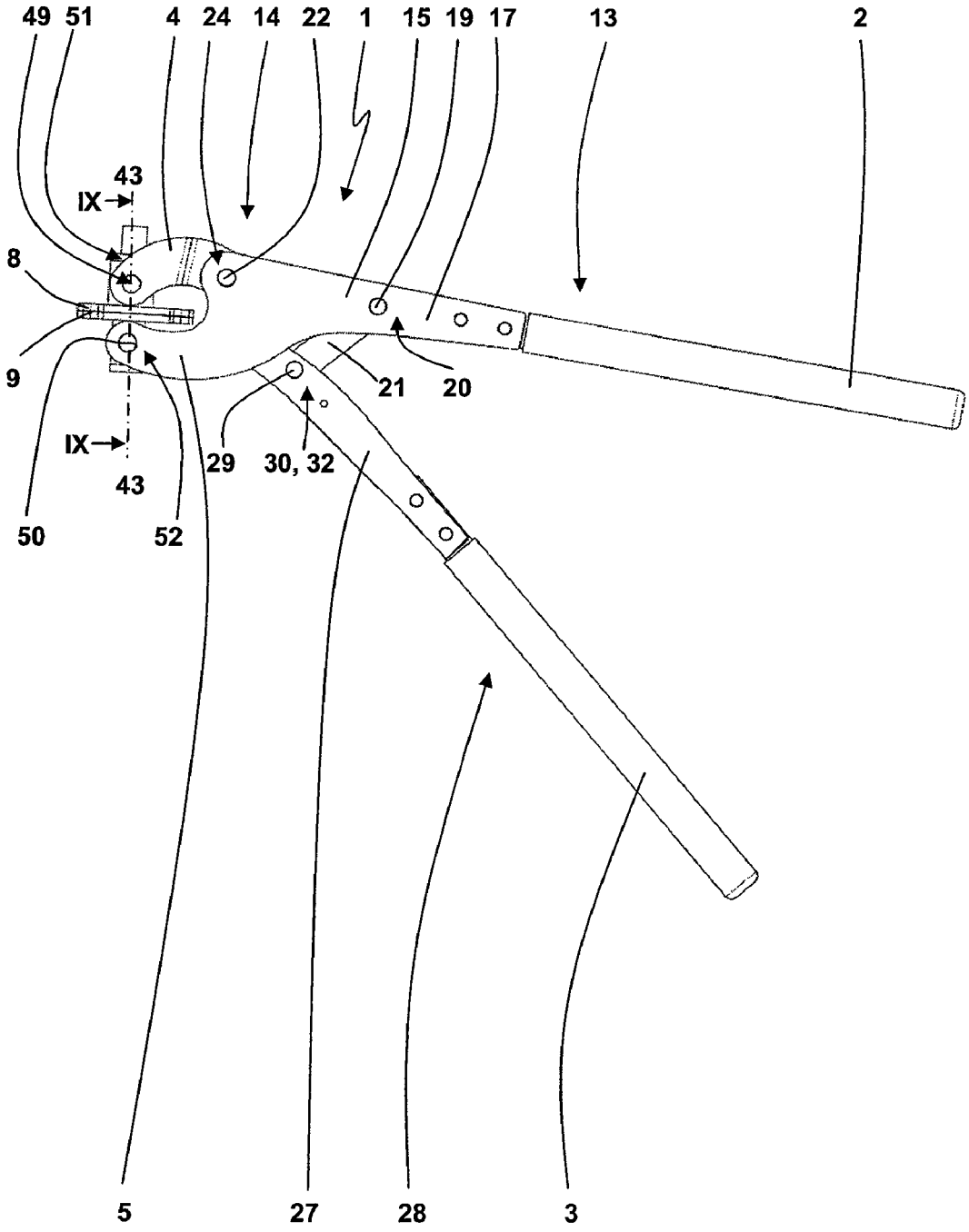
FIG. 1 is a plain view of the inventive pliers for opened hand levers.
Figure 2:
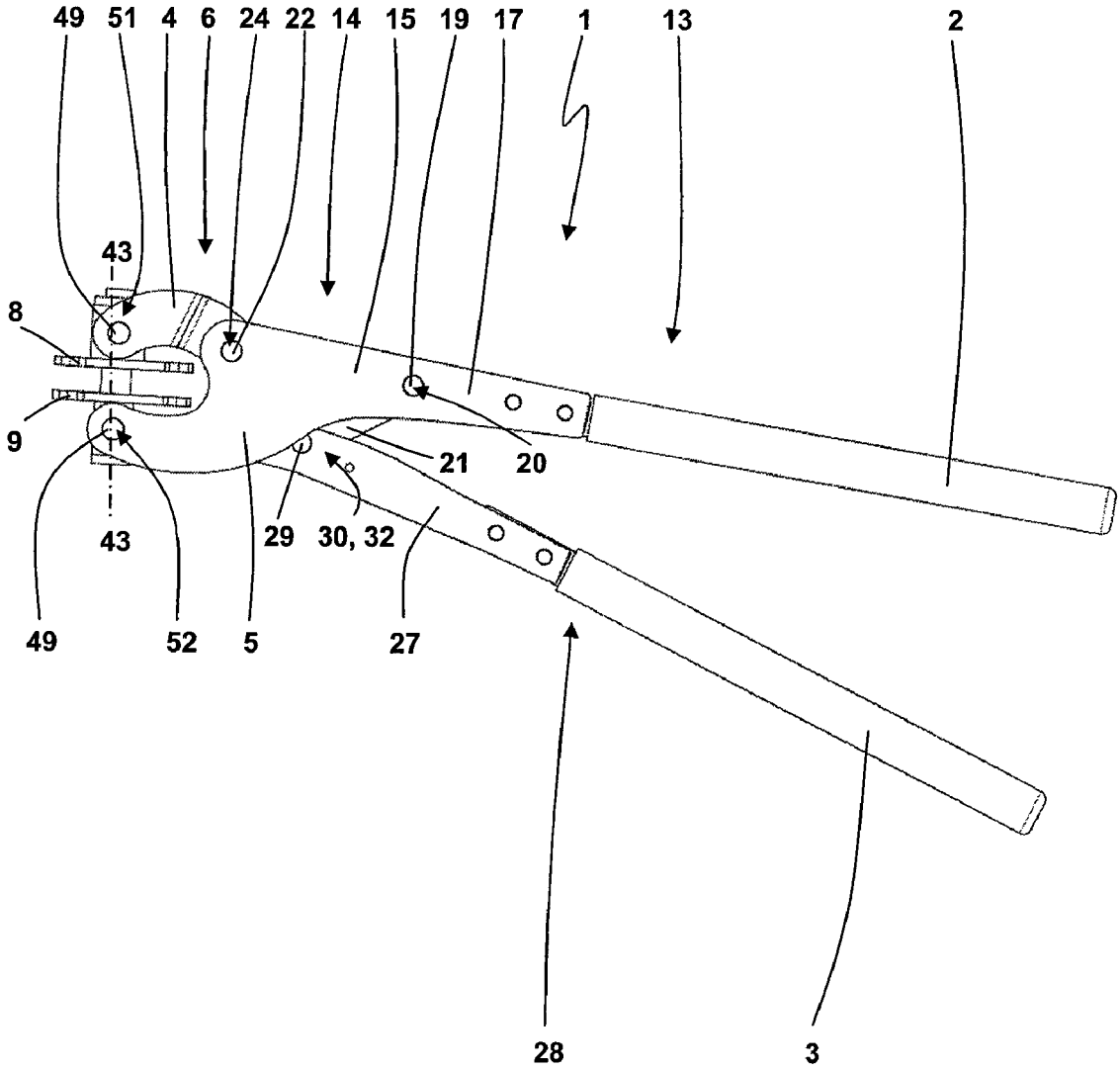
FIG. 2 is a plain view of the inventive pliers according to FIG. 1 for partially closed hand levers.
Figure 3:
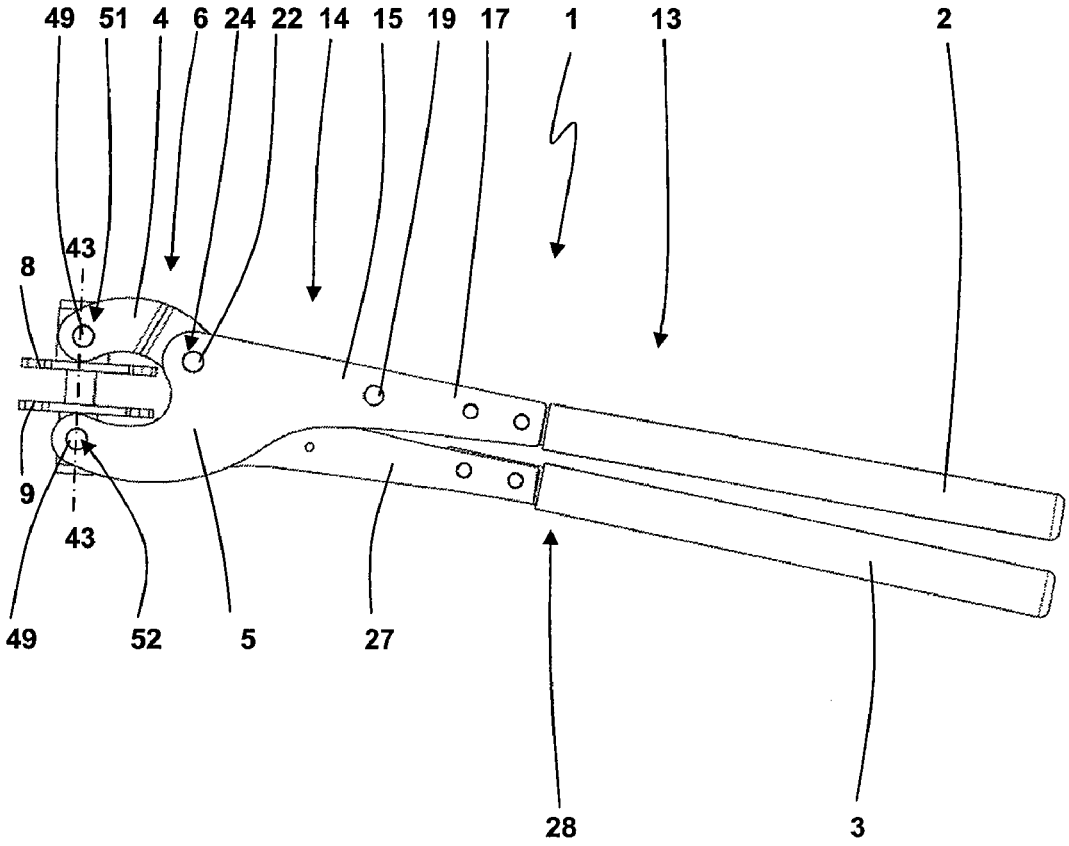
FIG. 3 is a plain view of the inventive pliers according to FIGS. 1 and 2 for completely closed hand levers.

Referring now in greater detail to the drawings, the drawings show an embodiment of the inventive pliers 1, wherein a first transfer mechanism 6 is interposed between hand levers 2, 3 and spreading jaws 4, 5. The transfer mechanism 6 comprises a toggle mechanism 7. However, the inventive base principle, in particular

- the spreading movement of the spreading jaws 4, 5 with a closing movement of the hand levers 2, 3 and/or
- the use of spreading elements 8, 9 with a plurality of nests 10, 11, 12 and/or
- the rotatable or revolver-like coupling of the spreading elements 8, 9 with the spreading jaws 4, 5 does not necessarily require the transfer mechanism 6 with a toggle mechanism 7. Any transfer mechanism 6 having a different toggle mechanism, cam drives, a transmission unit, a linked bar drive or the like might also be used. Furthermore, the present invention also covers pliers basing on a principle wherein a pivoting or translational movement of the hand levers 2, 3 towards each other introduces a translational movement of the spreading jaws 4, 5.

The pliers 1 according to FIG. 1 comprise a fixed part 13 building the hand lever 2. The fixed part 3 carries in the end region facing a head 14 of the pliers two parallel supporting plates 15, 16. The supporting plates 15, 16 are fixed at the fixed part 13 with screws or rivets. The supporting plates 15, 16 are integrally built with an extension extending the hand levers 2 versus the head 14 of the pliers. Furthermore, the supporting plates 15, 16 integrally build a spreading jaw 5 which in a first approximation is C-shaped. The C-shaped spreading jaw 5 extends from the end region of the extension 17 facing the head 14 of the pliers. A virtual connecting line connecting the end regions of the C-shaped spreading jaw 5 with the longitudinal axis of the hand lever 2 builds an angle of approximately 135°±20° with the extension 17.

Approximately in the middle between the end regions of the extension 17 the supporting plates 15, 16 carry a pivoting bolt 19 having an orientation transverse to the plane of the supporting plates 15, 16 and transverse to the drawing plane of FIGS. 1 to 5. The pivoting bolt 19 serves for building a joint 20 holding the end region of a pressure rod 21 with a pivoting degree of freedom around the pivoting bolt 19.

Another pivoting bolt 22 is located in the end region of the extension 17 facing the head 14 of the pliers and has an orientation parallel to the pivoting bolt 19. The pivoting bolt 22 is held by the supporting plates 15, 16. The pivoting bolt 22 serves for building a joint 24 for the spreading jaw 4. The spreading jaw 4 is in a first approximation C-shaped or comprises the shape of a segment of a circular ring with a circumferential angle of 150° to 180°. An end region of the spreading jaw 4 facing the extension 27 is linked with a pivoting bolt 25 having an orientation transverse to the drawing plane according to FIGS. 1 to 5 for building a joint 26. The pivoting bolt 25 is rotatably supported by the supporting plates 15, 16. The extension 27 fixed at the hand lever 3 and the hand lever 3 build a movable part 28 of the pliers.

Figure 4:
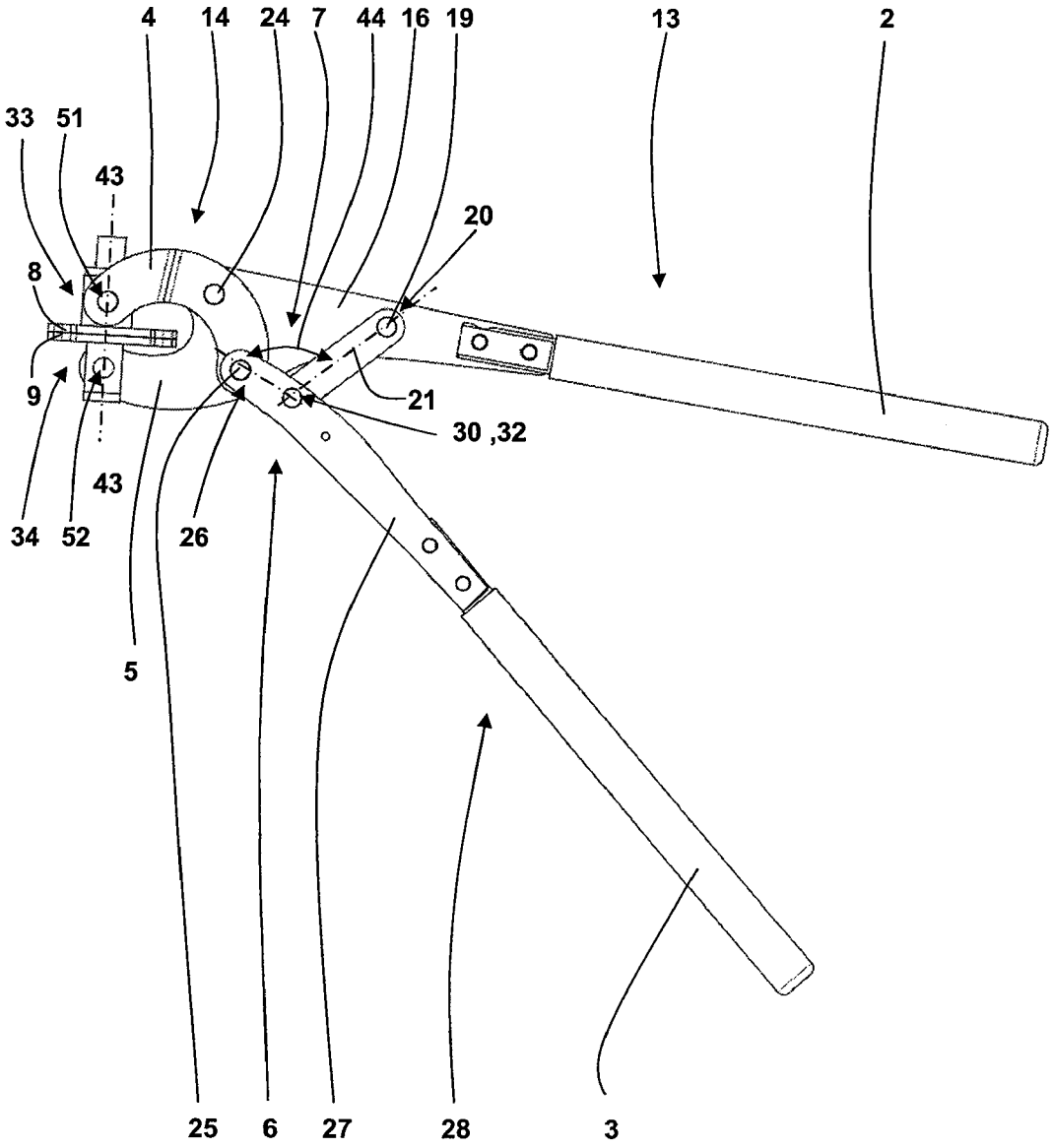
FIG. 4 is a plain view of the pliers corresponding to FIG. 1, wherein a supporting plate of the fixed part of the pliers is removed for showing the interior with the transfer mechanism of the pliers.
Figure 5:
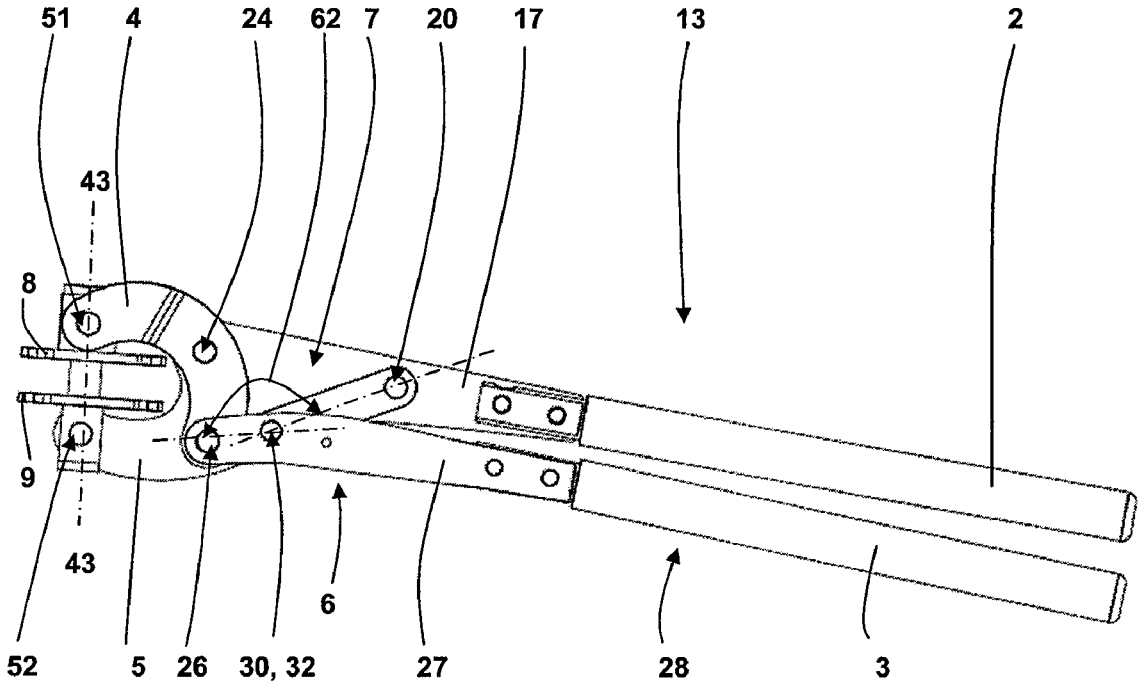
FIG. 5 is a plain view of the pliers corresponding to FIG. 3, wherein a supporting plate of the fixed part of the pliers is removed for showing the interior with the transfer mechanism of the pliers.

FIGS. 1 and 4 show the pliers for opened hand levers 2, 3. In the opened state the outer end regions of the spreading jaws 4, 5 have their minimal distance. The end region of the pressure rod 21 opposite to the joint 20 is pivotably linked with the movable part 28 of the pliers via a pivoting bolt 29 having an orientation perpendicular to the drawing plane of FIGS. 1 to 5. A joint 30 built with the pivoting bolt 29 is located at the extension 27, in particular adjacent to the joint 26. It is possible that the distance of the joints 26, 30 is between one-tenth or one-twenties of the length of the movable part 28 of the pliers.

The toggle mechanism 7 is built with the moved part 28 of the pliers and the pressure rod 21, wherein the joint 30 builds the toggle lever joint 32. For the state of the pliers 1 shown in FIGS. 1 and 4, the pressure rod 21 and the region of the movable part 28 between the joints 26, 30 build a first angle 44 of the toggle mechanism. The first angle 44 might be in the range of 90° to 140°, in particular in the range of 100° to 120°. For the partially closed state of the pliers shown in FIG. 2, the distance of the outer end regions of the spreading jaws 4, 5 has increased with the pivoting movement of the spreading jaw 4 around the joint 24 in clockwise direction. For the completely closed state of the pliers 1 according to FIGS. 3 and 5, the hand levers 2, 3 have reached their minimal distance, wherein the hand levers have an orientation which is approximately parallel. Such state corresponds with the outer end regions of the spreading jaws 4, 5 having reached their maximal distance. In such state, the toggle mechanism comprises a second angle 62.

Figure 6:
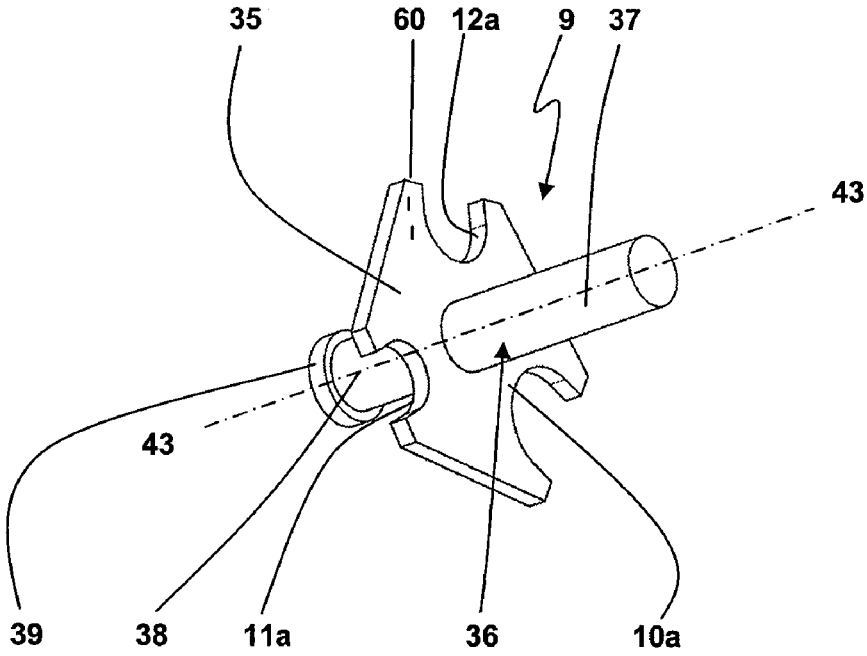
FIG. 6 is a first spreading element related with a first spreading jaw of the inventive pliers in a three-dimensional view.
Figure 7:
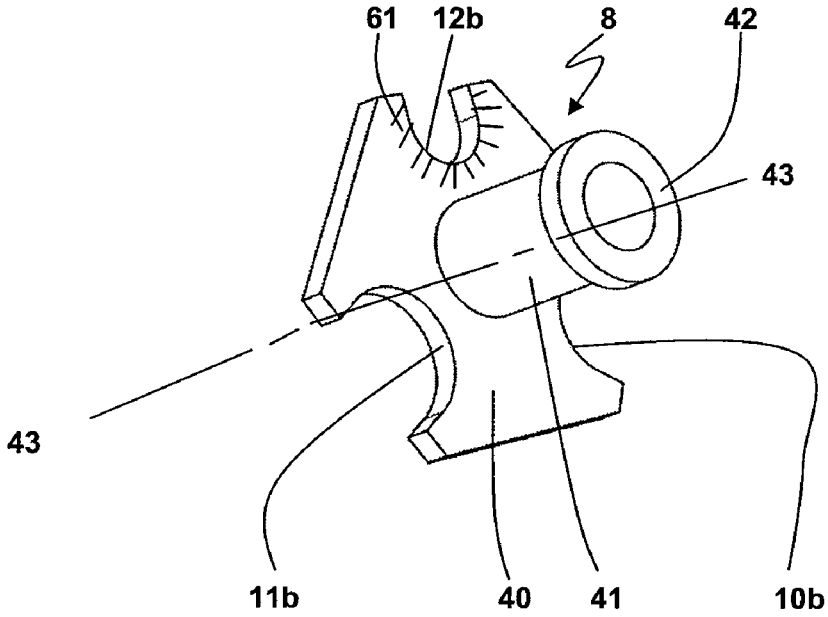
FIG. 7 is a second spreading element related with a second spreading jaw of the inventive pliers in a three-dimensional view.

It is possible that the spreading jaws 4, 5 directly build the activation surfaces. In such case it is possible that the activation surfaces are built at the outer end regions of the spreading jaws 4, 5 at opposite sides of the spreading jaws 4, 5 directed away from each other. Activation surfaces of the components of the connection contact these activation surfaces of the spreading jaws 4, 5 for transferring the spreading forces. However, for the shown embodiment the pliers comprise additional spreading elements 8, 9. The spreading elements 8, 9 are coupled with the spreading jaws 4, 5 via a second transfer mechanism 33, 34. In FIGS. 6 and 7 the spreading elements 8, 9 are shown as single components. The spreading element 9 is built with a stiff triangular plate 35. A guiding bolt 36 extends through the middle of the plate 35. The guiding bolt 36 builds a protrusion 37, 38 on each side of the plate 35, wherein the protrusion 38 builds a collar 39 in its end region. The corners of the plate 35 are equipped with recesses building nests 10*a* to 12*a*. The nests 10*a* to 12*a* might have a semi-circular shape or might be U-like or fork-like shaped and might have differing opening widths.

The spreading element 8 is built with a plate 40 having a shape similar to that of the plate 35. The plate 40 comprises recesses building nests 10*b* to 12*b*. On the side of the plate 40 facing the spreading jaw 4 the plate 40 in the middle carries a hollow sleeve 41 having a collar 42 at the outer end region.

For a coaxial alignment of the spreading elements 8, 9, the spreading element 8 with sleeve 41 building a through hole might be passed over the protrusion 37 of the spreading element 9 building a guidance in longitudinal direction along the spreading axis 43-43. For the circular cross-sections of the protrusion 37 and the inner bore of the sleeve 41 shown in FIGS. 6 and 7 the spreading elements 8, 9 comprise an additional rotational degree of freedom. For an alternative embodiment, non-circular cross-sections might be used for removing the rotational degree of freedom but leaving the translational degree of freedom along the spreading axis 43-43. Furthermore, contours of the cross-sections differing from circular contours might determine fixed positions for the orientations of the nests 10 to 12 in the assembled state.

Figure 8:
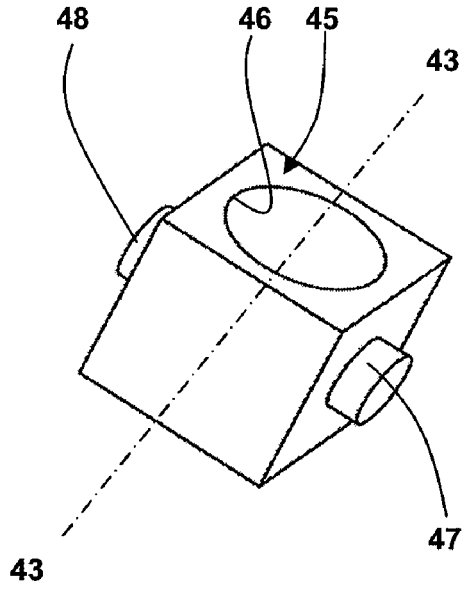
FIG. 8 shows a bearing body of a transfer mechanism interposed between a spreading jaw and a spreading element in a three-dimensional view.

A bearing body 45 has in a first approximation a cubic shape, see FIG. 8. The bearing body 45 comprises an inner through hole 46. Furthermore, the bearing body 45 comprises bearing pins 47, 48 being located at opposite sides and extending transverse to the spreading axis 43-43 and to the longitudinal axis of the inner bore 46.

Figure 9:
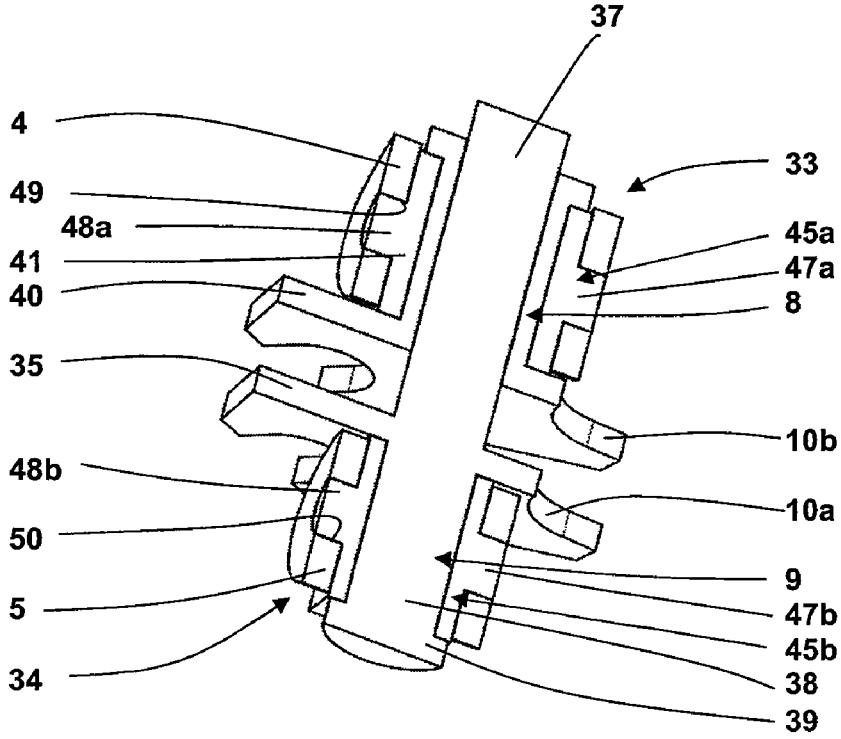
FIG. 9 is a three-dimensional view of an assembly group of the inventive pliers with two spreading elements located in bearing bodies slidably guided against each other.

FIG. 9 shows a sectional view of the pliers 1 through a plane comprising the spreading axis 43-43. As can be seen from FIG. 9, the bearing body 45*b* in a close fit enters between plate 35 and collar 39, wherein the protrusion 38 extends through the inner bore 46. Another corresponding bearing body 45*a* with a close fit enters between plate 40 and collar 42 of spreading element 8. The protrusion 41 extends through the inner bore 46 which has a larger diameter than the diameter of the inner bore 46 of the bearing body 45*b*. However, it is also possible that the spreading elements 8, 9 are designed such that the outer diameter of the protrusion 38 corresponds to the outer diameter of the sleeve 41 such that the inner bores 46 of both bearing bodies 45*a,b* might comprise the same diameters.

The pins 47, 48 of the bearing body 45*a* are pivotably mounted in a bore 49 of the spreading jaw 4 building a pivoting axis perpendicular to the drawing plane of FIGS. 1 to 5. The bore 49 is located in the outer end region of the spreading jaw 4. For the shown embodiment, the spreading jaw 4 is built with two parts of the spreading jaws in parallel orientation. The two parts each have a bore 49, wherein the bearing body 45*a* is housed between the two parts of the spreading jaw. The bearing pins 47, 48 of the other bearing body 45*b* are supported in a bore 50 of the spreading jaw 5, wherein the bore 50 might be provided in both supporting plates 15, 16 such that the bearing body 45*b* is held between the supporting plates 15, 16. The bearing pins 47, 48 together with the bores 49, 50 build joints 51, 52 for holding the bearing body 45 and the spreading elements 8, 9 with a pivoting degree of freedom relative to the spreading jaws 4, 5. Accordingly, a second transfer mechanism 33, 34 is built with the bearing bodies 45*a*, 45*b*, the bores 49, 50 and the joints 51, 52.

A fixing unit not shown in the figures might be used for fixing the rotational degree of freedom of the spreading elements 8, 9 around the spreading axes 43, 44. Such fixing unit might be built with a resting sphere or a resting element providing a resting connection between the upper surface or lower surface of the bearing body 45 with a collar 39, 42 or a plate 35, 40.

During the pivoting movement of the hand levers 2, 3 the spreading axis 43-43 slightly moves in horizontal direction in FIG. 1. This is due to the fact that the joint 51 moves relatively to the fixed part 13 of the pliers and the joint 52 on a circular path. Accordingly, the feature of the patent claims that the second transfer mechanism produces a translational movement of the spreading elements along the spreading axis has to cover a mainly translational movement within a tolerable change of the angle or a slight curvature. In any case, the transfer mechanisms 33, 34 guarantee that the spreading elements 8, 9 are kept with parallel orientation during the movement of the hand levers 2, 3.

Figure 10:
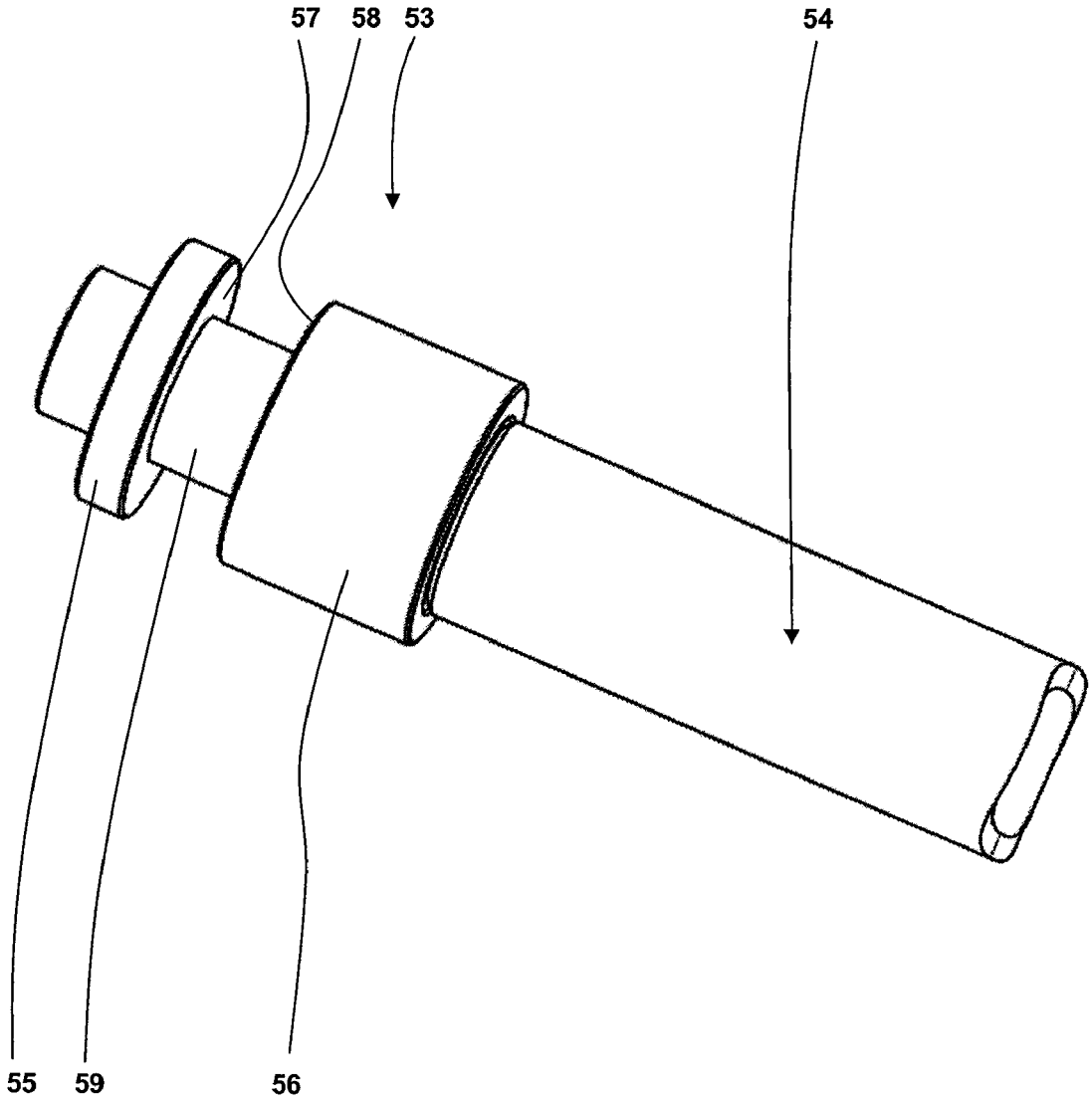
FIG. 10 shows a connection for conduits, wherein the connection might be radially crimped by spreading activation surfaces with the inventive pliers.

FIG. 10 shows a connection 53 for a conduit 54 radially pressed by axially spreading two components 55, 56 in axial direction of conduit 54. The components 55, 56 comprise activation surfaces 57, 58 facing each other. For the embodiment shown in FIG. 10, the activation surfaces 57, 58 are ring-shaped. The connection 53 is crimped by axially spreading and axially pressing the activation surfaces 57, 58 apart by use of the pliers 1. For spreading the components 55, 56, the pliers 2 are brought into the starting state shown in FIG. 1 with completely opened hand levers 2, 3. The spreading elements 8, 9 are rotated such that nests 10 to 12 suitable for the connection 53 are aligned with each other and in particular located at the outer side or front side of the pliers 1. The opening width of the nest 10 to 12 is chosen such that the nest is suitable for being passed over the cylindrical section 59 of connection 52. In the subsequent spreading step the pliers are moved towards the connection 53 such that the plates 35, 40 are introduced between the activation surfaces 57, 58. The section 59 enters into one of the nests 10 to 12.

This is as an example described for a chosen nest 12: on sides of the plates 35, 40 directed away from each other the plates 35, 40 build activation surfaces 60, 61 of the spreading elements 8, 9. In the embodiment shown in FIGS. 6 and 7 the activation surfaces 60, 61 are U-shaped. With a pivoting movement of the hand levers 2, 3 towards each other the plates 35, 40 are spread away from each other such that the activation surfaces 60, 61 come into contact with the activation surfaces 57, 58. A further pivoting movement of the hand levers 2, 3 towards each other together with the application of activation forces by the user produces a spreading force between the activation surfaces 60, 57 and 61, 58 resulting in a spreading movement of the components 55, 56. The spreading movement correlates with a radial crimping process and the production of an elastic and/or plastic deformation.

The activation surfaces being contacted by the pliers 2 are built by components of the fitting. However, it is also possible that at least one of the activation surfaces 57, 58 is built by an end of the conduit or tube. The assembly of the connection might include an elastic and/or plastic deformation of components of the fitting and/or tube ends.

Many variations and modifications may be made to the preferred embodiments of the invention without departing substantially from the spirit and principles of the invention. All such modifications and variations are intended to be included herein within the scope of the present invention, as defined by the following claims.

We claim:

1. Pliers for changing the distance of two operating areas of two elements of a connection for conduits, wherein the change of said distance coincides with a plastic radial deformation of at least one of the elements, said pliers comprising:

a) two hand levers, b) two spreading jaws, c) means for transferring a manual force applied by a user upon said hand levers with a transfer ratio to spreading forces acting upon said spreading jaws, d) wherein said means is designed and arranged such that with a closing movement of said hand levers the distance of said spreading jaws is increased, wherein an increase of the distance of said spreading jaws results in a plastic radial deformation of at least one element of the connection, e) means, interposed between said spreading laws and two spreading elements, for transferring a pivoting movement of said spreading jaws into a translational movement of said spreading elements along a spreading axis or into a parallel movement of said spreading elements, f) means for directly guiding said spreading elements against each other along said spreading axis with a translational degree of freedom; and g) said spreading elements being rotatable with respect to said spreading axis.

2. The pliers of claim 1, wherein said spreading elements comprise a plurality of nests located at the outer circumference of said spreading elements.

3. The pliers of claim 1, wherein said means for increasing the distance of said spreading laws by a closing movement of said hand levers comprises a toggle mechanism.

4. The pliers of claim 2, wherein said means for increasing the distance of said spreading jaws by a closing movement of said hand levers comprises a toggle mechanism.

5. The pliers of claim 4, wherein a) said toggle mechanism comprises a toggle lever joint, b) means for said hand levers being in an opened state coinciding with said spreading jaws being in a closed state, wherein said toggle lever joint builds a first angle of said toggle lever joint and c) means for said hand levers being moved towards each other, wherein the angle of said toggle lever joint increases to a second angle of said toggle lever joint.

6. The pliers of claim 5, wherein the second angle of said toggle lever joint is between 170° and 179°.

7. The pliers of claim 1, wherein a) in a fixed part of said pliers a first hand lever of said hand levers is fixedly connected with a first spreading jaw of said spreading jaws, b) a pressure rod in one end region is pivotably linked with said fixed part of said pliers, c) a movable part of said pliers is in a joint in one end region pivotably linked with a second spreading jaw of said spreading jaws, said movable part of said pliers in the other end region building a second hand lever of said hand levers and said movable part of said pliers being pivotably linked with said pressure rod at a location between said second hand lever and said end region connected with said second spreading jaw, d) said second spreading jaw being pivotably linked with said fixed part of said pliers at a location between said joint and said end region opposing said joint.

8. The pliers of claim 2, wherein a) in a fixed part of said pliers a first hand lever of said hand levers is fixedly connected with a first spreading jaw of said spreading jaws, b) a pressure rod in one end region is pivotably linked with said fixed part of said pliers, c) a movable part of said pliers is in a joint in one end region pivotably linked with a second spreading jaw of said spreading jaws, said movable part of said pliers in the other end region building a second hand lever of said hand levers and said movable part of said pliers being pivotably linked with said pressure rod at a location between said second hand lever and said end region connected with said second spreading jaw, d) said second spreading jaw being pivotably linked with said fixed part of said pliers at a location between said joint and said end region opposing said joint.

9. The pliers of claim 1, wherein said means, interposed between said spreading jaws and two spreading elements, for transferring a pivoting movement of said spreading jaws into a translational movement of said spreading elements along a spreading axis or into a parallel movement of said spreading elements, is a joint.

10. The pliers of claim 1, wherein the means for fixing said spreading elements for predetermined angles of rotations around said spreading axis comprises a fixing unit.

11. The pliers of claim 2, wherein the means for fixing said spreading elements for predetermined angles of rotations around said spreading axis comprises a fixing unit.

12. The pliers of claim 10, wherein the means for activating or deactivating a resting or locking unit of said fixing unit comprises one element selected from the group of a spring and a magnet.

13. The pliers of claim 11, wherein the means for activating or deactivating a resting or locking unit of said fixing unit comprises one element selected from the group of a spring and a magnet.

14. The pliers of claim 1, comprising means for guiding the spreading elements against each other along the spreading axis, wherein one of said spreading elements comprises a recess or a sleeve housing a protrusion of the other of said spreading elements.

* * * * *